US010000995B2

(12) United States Patent
Bishop et al.

(10) Patent No.: US 10,000,995 B2
(45) Date of Patent: Jun. 19, 2018

(54) COMPLETION SYSTEMS INCLUDING AN EXPANSION JOINT AND A WET CONNECT

(71) Applicants: David S. Bishop, Houston, TX (US); Marc N. Samuelson, Houston, TX (US)

(72) Inventors: David S. Bishop, Houston, TX (US); Marc N. Samuelson, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 193 days.

(21) Appl. No.: 14/079,019

(22) Filed: Nov. 13, 2013

(65) Prior Publication Data

US 2015/0129240 A1 May 14, 2015

(51) Int. Cl.

| | |
|---|---|
| ***E21B 17/07*** | (2006.01) |
| ***E21B 43/12*** | (2006.01) |
| ***E21B 23/02*** | (2006.01) |

(52) U.S. Cl.

CPC ..... *E21B 43/12* (2013.01); *E21B 17/07* (2013.01); *E21B 23/02* (2013.01)

(58) Field of Classification Search

CPC ..... E21B 17/023; E21B 17/028; E21B 17/07; E21B 43/10

See application file for complete search history.

(56) References Cited

U.S. PATENT DOCUMENTS

| | | | | |
|---|---|---|---|---|
| 6,540,025 | B2 * | 4/2003 | Scott | E21B 23/02 166/338 |
| 7,509,000 | B2 | 3/2009 | Coronado | |
| 7,556,093 | B2 | 7/2009 | Grigsby et al. | |
| 7,607,477 | B2 | 10/2009 | Stoesz et al. | |
| 2006/0260818 | A1 * | 11/2006 | Meijer et al. | 166/380 |
| 2013/0048307 | A1 | 2/2013 | Patel | |
| 2013/0118757 | A1 * | 5/2013 | Barrilleaux et al. | 166/373 |
| 2015/0204145 | A1 * | 7/2015 | Richards et al. | 166/380 |

FOREIGN PATENT DOCUMENTS

| | | | |
|---|---|---|---|
| EP | 2287439 | A1 | 2/2011 |
| WO | 2007119052 | A1 | 10/2007 |

OTHER PUBLICATIONS

PCT International Search Report and Written Opinion; International Application No. PCT/US2014/065361; International Filing Date: Nov. 13, 2014; dated Mar. 16, 2015; pp. 1-17.

* cited by examiner

*Primary Examiner* — Kipp C Wallace
(74) *Attorney, Agent, or Firm* — Cantor Colburn LLP

(57) ABSTRACT

A production string for use in a wellbore is disclosed that in a non-limiting embodiment includes a lower section that includes a first tubular having a first connection device at a top end thereof, and an upper section that includes a second tubular that sealingly slides against the first tubular, a second connection device associated with the second tubular configured to engage with the first connection device, and an expansion joint above the second tubular.

19 Claims, 1 Drawing Sheet

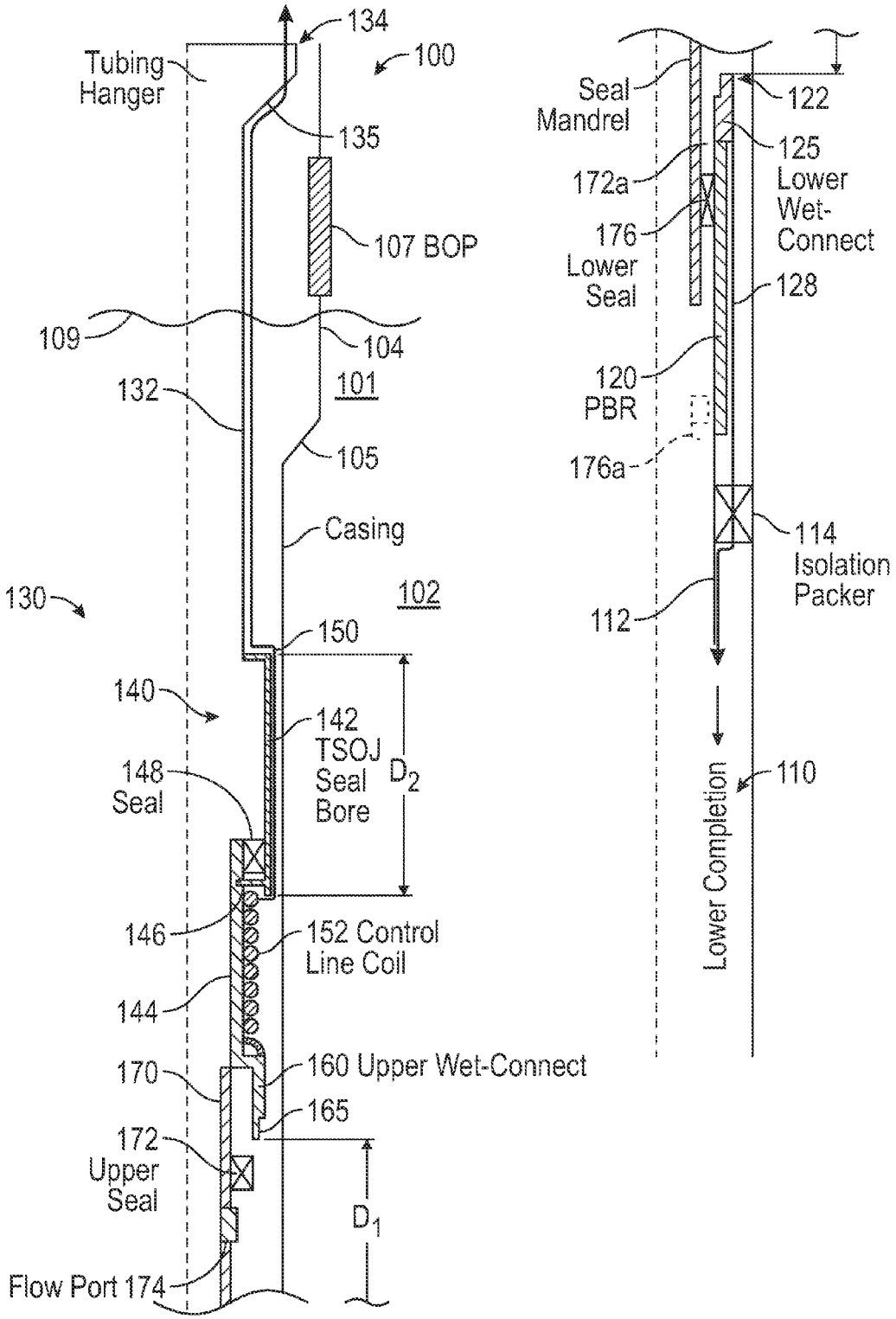
134
100
Tubing Hanger
135
107 BOP
109
104
101
132
105
Casing
102
130
150
140
142 TSOJ Seal Bore
$D_2$
148 Seal
146
152 Control Line Coil
144
170
160 Upper Wet-Connect
165
172 Upper Seal
$D_1$
Flow Port 174
Seal Mandrel
122
125 Lower Wet-Connect
172a
176 Lower Seal
128
120 PBR
176a
114 Isolation Packer
112
110
Lower Completion

COMPLETION SYSTEMS INCLUDING AN EXPANSION JOINT AND A WET CONNECT

BACKGROUND

1. Field of the Disclosure

This disclosure relates generally to a completion system wherein a production string for the production of hydrocarbons may include an expansion joint for accommodating variations in the length of the production string and a wet connect.

2. Background of the Art

Wells or wellbores are drilled in subsurface formations for the production of hydrocarbons (oil and gas). Modern wells can extend to great well depths, sometimes more than 2,500 meters (about 25,000 ft.). Hydrocarbons are trapped in various traps in the subsurface formations at different depths. The areas of the formation that contain the hydrocarbons are referred to as reservoirs or hydrocarbon-bearing formations or production zones. The wellbore is lined with a casing and the annulus between the casing and the wellbore is filled with cement. Perforations are made through the casing and the formation to allow the hydrocarbons to flow from the production zones into the wellbore. A production string is placed inside the casing to lift the hydrocarbons from the wellbore to the surface. A production string typically includes a lower completion section that includes various devices, such as sand screens, valves, packers, etc. in front of each zone and an upper completion section that typically includes a long tubing made by connecting or joining pipe sections, each about 30 feet in length. A liner hanger is placed on top of the tubing to attach or hang the tubing inside the casing at a selected location below the surface level. To deploy the production string, the lower completion section is deployed in the wellbore. The upper completion section is then lowered into the wellbore and attached to the top of the lower completion section. Operators determine the length of the upper completion section needed to hang the liner hanger at the selected location in the casing and to connect the upper completion section to the lower completion section. For deep wellbores, the tubing length can exceed 1,500 meters (about 15,000 feet). Due to the weight of the tubing, play in the tubing joints and for the expansion of the tubing after installation, an expansion joint is provided in the tubing to accommodate for such the tubing length changes.

The disclosure herein provides a completion system wherein a production string includes a device that can accommodate relatively large tubing length variations during deployment and an expansion joint for accommodating variations in length after deployment.

SUMMARY

In one aspect, a production string for use in a wellbore is disclosed that in a non-limiting embodiment includes a lower section that includes a first tubular having a first connection device at a top end thereof, and an upper section that includes a second tubular that sealingly slides against the first tubular, a second connection device associated with the second tubular configured to engage with the first connection device, and an expansion joint above the second tubular.

In another aspect, a method of completing a well is disclosed that in one non-limiting embodiment includes: providing a production string that includes a lower section having a first tubular having a first connection device at a top end thereof; deploying the lower section in the well; providing an upper section that includes a second tubular that sealingly slides against the first tubular, a second connection device above the second tubular configured to engage with the first connection device, and an expansion joint above the second connection device; lowering the upper section to connect the first connection device to the second connection device by sealingly sliding the second tubular against the first tubular and; lowering the upper section after connecting the first connection device to the second connection device using the expansion joint to set the upper section in the well.

Examples of the more important features of a well completion system are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein:

FIG. 1 shows a production string wherein a lower section of the production string containing a lower portion of a wet connect has been deployed in the wellbore and an upper section of the production string is in the process of being deployed in the wellbore.

DETAILED DESCRIPTION OF THE DRAWINGS

FIG. 1 is a line diagram of a non-limiting embodiment of a production string 100 for deployment in a wellbore 101 formed in a formation 102. The wellbore 101 is shown lined with a casing 104 that includes a landing 105 near the top of the casing 101. A blow-out-preventor 107 is deployed above the mud line 109 over the casing 101 to prevent blow-outs as is well known in the art. The production string 100 includes a lower string or completion section (also referred to herein as the "lower section") 110 and an upper completion string or upper completion section (also referred to herein as the "upper section") 130. The lower section 110 may include devices known in the art to facilitate the production of hydrocarbons from the formation to the surface. Any suitable lower completion system may be utilized for the purposes of this disclosure and is thus not shown in detail herein. The lower completion section 110 is isolated from the upper completion section 140 by an isolation packer 114. The lower completion section 110 includes a tubular 112 that has a polished bore receptacle ("PBR") 120 at the top of the tubular and a wet connect carrier 122 having a lower wet connect 125 on top of the PBR 120. A control line (also referred to as the "communication line" or "communication link") 128 is run from the wet connect 125 to a circuit or control unit (not shown) in the lower completion section 110 for transmitting signals between the control circuit and the lower wet connect 125.

The upper section 130 includes a tubular 132 that has a tubing hanger 134 at its upper end. The tubing hanger 134 has a landing 135 that lands on or hangs on to the landing 105 in the casing 104 when the upper section 130 is deployed in the casing 101. The upper section 130 contains an expansion joint (that may be a telescoping space out joint or TSOJ) 140 connected to the bottom end of the tubular 132. In one aspect, the expansion joint 140 includes a seal bore 142. The seal bore 142 is connected to a tubular 144 via a shear device 146, such as a shear pin. A seal 148 provides a seal between the seal bore 142 and the tubular 144. An upper wet connect carrier 160 having an upper wet connect 165 is connected to the lower end of the tubular 144. In one aspect, a control line 150 may be run from the surface along the tubular 132 and then along the seal bore 142 and then coiled around the tubular 144, as shown by coil 152. The communication line 150 terminates at the upper wet connect 165. The tubular 144 is then connected to mandrel 170 that has an upper seal 172, a flow port 174 and a lower seal 176. As is known in the art, the casing 101 and the production string 100 are filled with a fluid, such as drilling fluid, to provide a hydrostatic pressure in the casing greater that the formation pressure along the length of the wellbore to prevents the fluid from the formation 104 to enter into the production string 100.

To connect the upper section 130 to the lower section and to connect the upper wet connect 165 to the lower wet connect 125, the tubular 132 is lowered to cause the lower seal 176 to engage with the PBR 120. When the lower seal 176 engages with the PBR 120, as shown in FIG. 1, pressure inside the upper section 130 increases, which produces a spike in the pressure measured at the surface. This enables an operator to know that the lower seal has engaged with the PBR 120. To connect the upper wet connect 165 to the lower wet connect 125, the flow port 174 allows fluid circulation to clean the area between the upper wet connect 165 and the lower wet connect 125. The upper section 130 is then lowered so that the upper wet connect 165 mates with the lower wet connect 125. Mating of the upper and lower wet connects 165 and 125 provides communication between the surface and the lower completion section 110. Mating of the upper and lower wet connects 165 and 125 prevents the upper section 130 to further move downward. The weight of the upper section 130 is not sufficient to break the shear device 146. At this stage, the lower seal 176 is at a location 176*a* and the upper seal 172 has engaged with the PBR as shown by location 172*a*. In addition, the landing 135 of the tubing hanger 134 is still above the landing 105 of the casing 101. The distance "D1" between the lower wet connect 125 and the upper wet connect 165 is selected so that when the wet connects 125 and 165 mate, the landing 135 will remain above the landing 105 by a known distance. The tubular 132 is then pushed downward to break the shear device 142, which enables the seal bore 142 of the TSOJ 140 to move along the tubular 144 via the seal 146, which compresses the coil 152. The distance "D2" is greater than the distance needed to place the landing 135 onto the landing 105 after breaking the shear device 144. The communication link containing the links 128 and 150 may include one or more hydraulic lines, electrical lines (conductors), fiber optic lines and/or any other type of communication links known in the art. Various types of wet connects are known in the art and any suitable wet connect and communication link may be utilized for the purposes of this disclosure.

Thus, in one non-limiting embodiment, the disclosure provides a completion system wherein a production string includes a lower completion section and an upper completion section. In one aspect, a lower wet connect carrier is placed at the top of a PBR above the lower completion section. A first control line is run from the lower wet connect carrier through an isolation packer to the lower completion section. The upper completion section includes an extended mandrel with two sets of seals (an upper seal set and a lower seal set) below an upper wet connect carrier, with a flow port placed below the upper seal set. When the upper completion section is lowered into the wellbore, the lower seal set engages with the PBR and the pressure spike is read at the surface. The Flow Port allows for circulation between the lower wet connect and the upper wet connect. The upper string is then lowered so that the upper seal set engages with the PBR and the upper wet connect fully mates (engages) with the lower wet connect. A TSOJ with a coiled control line is placed above the upper connect carrier with a higher shear force than is required to mate the upper wet connect with the lower wet connect. The TSOJ is sheared and moved downward to set the liner hanger in the casing. The coil and the TSOJ allow for tube movement throughout the life of the well.

Long production strings require long stack-up requirements, which can necessitate a long expansion joint to allow for the make-up of a tubing hanger made by joining pipe sections and for additional 'play' in the system, such as due to the weight of the tubing. The production string 100 provides a first stroke (distance D1) via the mandrel to deploy the upper section 130 of the production string 100 (to connect the upper and lower wet connects) and a second stroke (distance D2) via the telescopic expansion joint 140 to set the liner hanger 134 in the casing 101. The production string 100 further provides coiled control lines (fiber optic, hydraulic, or electric) around the telescopic member 144 to allow for the compression of the control line during deployment of the production string 100 and for contraction and expansion of the production string 100 thereafter. Use of both a PBR and an expansion joint 140 allows for the full required stroke without requiring control line coil to cover the distance. In one aspect, the first stroke may be substantially greater than the second stroke. For a total stroke of 120 feet, in one embodiment, the first stroke may be about 100 feet and the second stroke may be about 40, the combination thereby providing sufficient safety margin for correctly landing the liner hanger and also providing for the expansion of the production string over the life of the well.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A production string for use in a wellbore having a casing with a casing landing, the production string comprising:

a lower section that includes a first tubular having a first connection device at a top end thereof; and an upper section that includes:

a second tubular having a second tubular landing at a top end and having a setting stroke range;

an expansion joint at a bottom end of the second tubular, the expansion joint including a seal bore and a telescopic member, the telescopic member having second connection device at a bottom end configured to engage with the first connection device within the setting stroke range, the telescopic member including a coiled control line that connects with the second connection device;

a mandrel below the expansion joint having a lower seal configured to engage with the lower section, wherein the setting stroke range allows for engagement of the first connection device and the second connection device and the second tubular landing is spaced apart from the casing landing after engagement of the first connection device and the second connection device; and a shear device connecting the seal bore and the expansion joint that remains unbroken when the first connection device engages the second connection device and is broken to allow the expansion joint to compress over an expansion range to allow the casing landing to engage and the second tubular landing after engagement of the first connection device and the second connection device; and a seal of the seal bore that compresses the coiled control as the expansion joint compresses over the expansion range.

2. The production string of claim 1, wherein the mandrel further includes at an upper seal spaced apart from the lower seal and configured to sealingly engage with the first tubular.

3. The production string of claim 2, wherein the lower seal is positioned below the first connection device when the first and second connection devices engage with each other.

4. The production string of claim 1, wherein the first connection device includes a first part of a wet connect and the second connection device includes a second part of the wet connect.

5. The production string of claim 1, wherein the expansion joint includes a telescoping device.

6. The production string of claim 1, wherein the expansion joint slides against the second tubular when the shear device is broken.

7. The production string of claim 6, wherein the upper section includes a first communication link that runs from a surface location to the second connection device and is coiled around the expansion joint.

8. The production string of claim 7, wherein the lower section includes a second communication link that runs from the first connection device to a location in the lower section.

9. The production string of claim 8, wherein the first communication link and the second communication link each include a link selected from a group consisting o£ an electrical conductor; a fiber optic link; and a fluid line.

10. A production string for use in a wellbore, having a casing with a casing landing, the production string comprising:

a lower section that includes a lower wet connect on a top end of a first tubular and a first communication link that runs from the lower wet connect to a selected location in the lower section; and an upper section that includes:

a tubing having a tubing landing;

an expansion joint attached to a bottom end of the tubing, the expansion joint including a telescoping device having a telescopic member configured to slide against a second tubular member, wherein the telescopic member is restrained from sliding against the second tubular member by a shear device, wherein the expansion joint has an expansion range;

a second communication link that runs from a selected location above the expansion joint to the upper wet connect, wherein a portion of the second communication link is coiled around the telescopic member;

an upper wet connect below the expansion joint connected to the second communication link;

a mandrel below the upper wet connect, wherein the mandrel is configured to sealingly slide against the first tubular within a setting stroke range;

a lower seal on the mandrel configured to engage with the first tubular, wherein the setting stroke range allows for engagement of the lower wet connect and the upper wet connect and the tubing landing is spaced apart from the casing landing after engagement of the lower wet connect and the upper wet connect and wherein a portion of the expansion range allows for engagement of the casing landing and the second tubular landing after engagement of the first connection device and the second connection device;

wherein the shear device remains unbroken when the first connection device engages the second connection device and is broken to allow compression of the expansion joint over the expansion range to allow the tubing landing to engage the casing landing after engagement of the first connection device and the second connection device; and a seal of the telescopic member that compresses the second communication link as the expansion joint compresses over the expansion range.

11. The production string of claim 10, wherein:

the tubing includes a liner hanger at a top end of the tubing and a first landing for placement on a second landing in a casing in the wellbore;

the mandrel includes a lower seal and an upper seal; and wherein the liner hanger positions above a blow-out-preventor on the wellbore when the lower seal engages with the first tubular; and the liner hanger positions below the blow-out-preventor when the upper wet connect mates with the lower wet connect and before placement of the first landing onto the second landing.

12. The production string of claim 10, wherein the first tubular is a polished bore receptacle.

13. The production string of claim 10 further comprising an upper seal spaced apart from the lower seal, wherein the upper seal and lower seal enable the mandrel to sealingly slide against the first tubular.

14. The production string of claim 13, wherein the mandrel includes a flow port that provides fluid communication between the upper wet connect and the lower wet connect when the mandrel is in a sealing arrangement with the first tubular.

15. The production string of claim 10, wherein the first and second communication links each includes a link selected from a group consisting of: an electrical conductor; a fiber optic link; and a fluid line.

16. A method of completing a well having a casing with a casing landing, the method comprising:

providing a production string that includes a lower section having a first tubular having a first connection device at a top end thereof;

deploying the lower section in the well;

providing an upper section that includes a second tubular having a second tubular landing, and a setting stroke range, an expansion joint below the second tubular, the expansion joint including a seal bore and a telescopic member, the seal bore having a seal and the telescopic member including a second connection device at a bottom end configured to engage with the first connection device with the setting stroke range and a coiled control line that connects with the second connection device, a mandrel below the expansion joint having a lower seal, wherein the setting stroke range allows for engagement of the first connection device and the second connection device and the second tubular landing is spaced apart from the casing landing after engagement of the first connection device and the second connection device, and a shear device that connects the seal bore to the telescopic member, wherein the expansion joint has an expansion range, wherein a portion of the expansion range allows for engagement of the casing landing and the second tubular landing after engagement of the first connection device and the second connection device;

lowering the upper section to engage the lower seal of the second tubular to the first tubular;

connecting the first connection device to the second connection device by sealingly sliding the second tubular against the first tubular within the setting stroke range, wherein the second tubular landing is spaced apart from the casing landing after connecting of the first connection device and the second connection device;

after connecting the first connection device to the second connection device, breaking the shear device and lowering the upper section within a portion of the expansion range to engage the casing landing to the second tubular land to thereby set the upper section in the well, wherein the seal of the seal bore compresses the coiled control of the telescopic member as the expansion joint compresses over the expansion range.

17. The method of claim 16, wherein the first connection device and the second connection device each is a wet connect.

18. The method of claim 16 further comprising:

running a first communication link from the first connection device to a location in the lower section; and running a second communication link from the second connection device to a location above the expansion joint.

19. The method of claim 16, wherein the mandrel includes a port that provides fluid communication between the first connection device and the second connection device when the second tubular is in a sealing arrangement with the first tubular.

* * * * *